United States Patent [19]

Haines et al.

[11] 4,407,185

[45] Oct. 4, 1983

[54] RETURN AIR FLOW CONTROL FOR VARIABLE AIR VOLUME SYSTEM

[75] Inventors: Roger W. Haines, Laguna Hills, Calif.; Mark A. Purinton, South Glens Falls, N.Y.

[73] Assignee: Borg-Warner Corporation, Chicago, Ill.

[21] Appl. No.: 351,634

[22] Filed: Feb. 23, 1982

[51] Int. Cl.[3] ..... B64D 13/00; F25B 29/00

[52] U.S. Cl. ..... 98/1.5; 98/33 A; 165/16; 236/49; 417/2

[58] Field of Search ..... 236/49; 165/16; 98/1.5, 98/33; 417/2

[56] References Cited

U.S. PATENT DOCUMENTS

Re. 28,946 8/1976 Martz et al. ..... 165/16 X 3,402,654 9/1968 Berst ..... 236/49

3,982,583 9/1976 Shavit et al. ..... 165/16

OTHER PUBLICATIONS

Fan Selection & Control, ASHRAE Journal, Neil R. Patterson, 1977.

Variable Air Volume System Controls Milewski, Heating/Piping/Air Conditioning 7, 1977.

*Primary Examiner*—William E. Wayner

*Attorney, Agent, or Firm*—Thomas B. Hunter

[57] ABSTRACT

A variable air volume (VAV) system in which the inflow of outside air is maintained above a predetermined value by maintaining a substantially fixed negative pressure in the plenum by the use of a static pressure sensor and control system for controlling the speed of the return fan.

6 Claims, 2 Drawing Figures

RETURN AIR FLOW CONTROL FOR VARIABLE AIR VOLUME SYSTEM

BACKGROUND OF THE INVENTION

1. Field of the Invention

Variable air volume (VAV) heating/cooling systems with means for controlling the flow of return air. VAV systems are generally classified in Class 62—Subclass 186—Automatic control—of external fluid-air controller or damper; and in Class 165—various automatic control subclasses.

2. Description of the Prior Art

VAV systems are a type of all-air system currently used to condition the air supplied to a space (or "zone") in buildings or plants. The design and configurations of such systems are described in the *ASHRAE Handbook and Product Directory* (1980 Edition)—*Systems*, Chapter 3.

Generally, these systems include supply ductwork and a "mixed air" plenum chamber in which outside and return air are mixed prior to further conditioning (by heating or cooling coils) and filtering before being discharged into the supply ductwork. One or more supply fans draw conditioned air from the plenum chamber and force the air into the ductwork to the space requiring the conditioned air. Usually, one or more return fans draw the air back from the conditioned space and force it into the mixed air plenum. A portion of the air discharged from the return fan may be exhausted to the outside.

The air flow rate of the outside air which enters the mixed air plenum chamber is typically controlled by volume dampers and by the relative flow rates of the air at the supply and return fan(s). The static pressure within the mixed air plenum chamber must be negative with respect to the outside barometric pressure in order for outside air to flow into the plenum. At design (maximum) flow conditions, relative flow rates of supply and return air usually are such that a minimum flow rate of outside air is assured to enter the mixed air plenum. The prior art consists of many control systems and variations which control the supply and return fan air flow rates so as to maintain a fixed difference between the two. As an example, U.S. Pat. No. 4,011,735 describes a control system which maintains a fixed relationship between supply and return systems. With this control system, and similar control systems, it is possible that outside air flow rates will be reduced below minimum "design" values as the supply and return fan flow rates decrease.

Such systems do not insure that minimum outside air will be drawn into the plenum and mixed with the recirculated "return" air. If the supply and return air flow rates are reduced below, say 50% percent, of design flow requirements, the outside air flow rate could well be reduced below code requirements, as a result of the higher static pressure (the static pressure becoming less negative than outside pressure) in the mixed air plenum chamber.

SUMMARY OF THE INVENTION

This invention relates to control systems for VAV systems and more particularly to means for controlling the return air to assure that a minimum amount of outside air will be drawn into the mixing plenum, regardless of the supply and return air flow rates. Means for sensing the flow of air upstream from the mixing chamber is employed to transmit a signal to the return air fan motor controller to maintain a negative static pressure in the mixing chamber to the degree necessary to maintain the flow of outside air above a predetermined value.

DETAILED DESCRIPTION

Figure 1:
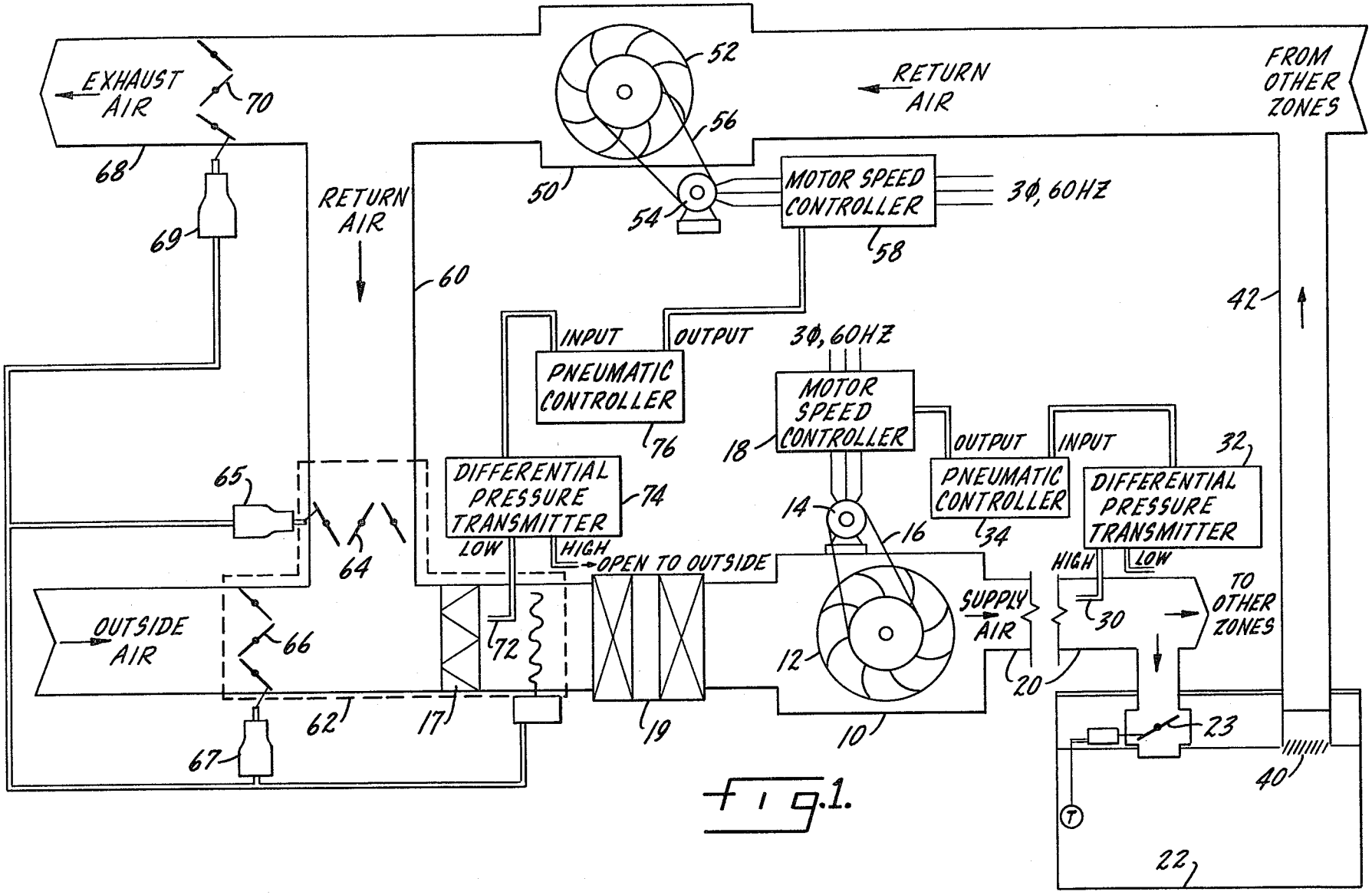
FIG. 1 is a block diagram (or control schematic) of a first embodiment of the invention, in combination with standard components of a VAV system which conditions one or more separate spaces (or zones)

In FIG. 1, a supply fan unit 10 is shown to include a fan 12 driven by a rotating shaft (typically from an electric motor 14) through a belt and pulley arrangement 16. A means of varying the airflow through the fan 12 is provided by a motor speed controller 18, but other means may also be used, such as variable inlet vanes at the fan inlet, discharge dampers at the fan discharge, a variable-sheave belt and pulley arrangement, or any other means of altering the air flow rate through the fan. The supply fan draws air through a filter 17 and an air conditioning unit 19 which may consist of cooling and/or heating coils, and located on the inlet side of the fan unit 10 (as shown in FIG. 1) or on the discharge side of the fan unit. Supply ductwork 20 receives the discharge air from the supply fan and conveys it to one or more spaces (zones) 22 in a building or facility served by the air system. The zone to which air is supplied usually contains one or more thermostatically controlled dampers 23 which control the flow of air into the space and maintain the desired temperature.

To control the air flow rate through the supply fans, some control technique is used which will control the supply air flow rate in accordance with a control signal which varies either directly or indirectly with the air-conditioning load in the spaces served by the VAV system. Frequently, the means used to control the supply air flow rate incorporates a duct static pressure sensor 30 which is connected by pneumatic tubing to a differential pressure transmitter 32. The differential pressure transmitter 32 is a commercially-available unit (such as the P-5217 transmitter manufactured by Johnson Controls, Inc.) which is capable of varying the pneumatic pressure in its output line in a proportional manner based on the measured differential static pressure. In the case of this particular transmitter, the duct static signal from the sensor is connected to the "High" port, while the "Low" port is open to the space or some suitable reference static pressure. The range of the particular transmitter used will depend on the likely range of supply duct static pressures which would occur at the sensing point. The differential static pressure transmitter 32 is connected to a receiver-controller 34 which receives the output pressure from the transmitter, compares it to a setpoint, and provides a pneumatic pressure output signal to the volume control device described above and depicted as a motor speed controller 18 in FIG. 1. The receiver-controller is a commercially-available unit and may be either a proportional-only or proportional-plus-reset type, the difference between the two being the relationship between the input and output signals. An example of such devices are the T-9000 series of penumatic controllers manufactured by Johnson Controls, Inc. It will be appreciated that the method of controlling supply fan air flow rate may be different than the particular scheme described above, and that the return fan control system embodied in this invention will work regardless of the particular control scheme used and the particular device used to vary the air flow rate at the supply fan.

The spent air which conditions the room is drawn through a return grille 40 into a return air duct 42, which is connected to the inlet side of a return fan unit 50, consisting of a return fan 52 driven by a rotating shaft (typically from an electric motor 54) through a belt and pulley arrangement 56. The return fan 52 may be similar to the supply fan 12 in construction and method of operation. The return fan 52 draws return air into the return ductwork 42 and discharges into a duct 60 which is connected to a plenum chamber 62, where the return air is mixed with outside air. The relative amount of outside air in the supply air is typically varied using a return air damper 64 and an outside air damper 66 installed within their respective ducts. An exhaust duct 68 (used for expelling a portion of the return air to the outside) and an associated exhausted air damper 70 are typically used in connection with what is known in the trade as an "economy cycle," designed to use outside air for cooling whenever possible based on the dry bulb temperature and, in some cases, the enthalpy of the outside air. The return air damper 64 and outside air damper 66 are connected via mechanical linkage to a return damper operator 65 and an outside damper operator 67 which open or close the dampers based on some control signal. When an exhaust air damper 70 is used, its motion is typically the same as that of the outside air damper 66.

The outside and return air damper operators 67 and 65 (and the exhaust damper operation 69, when used) are typically controlled so as to maintain an essentially constant mixed air temperature in the plenum chamber 62 at a point located downstream from the mixing area and representative of the mixture temperature of the return and outside air streams.

In the present invention, the method for controlling damper position through damper operators is not changed. We propose, in addition, the use of a duct static pressure sensor 72 connected to a differential pressure transmitter 74, which receives the duct static pressure signals and transmits an output signal to a receiver-controller 76. The receiver-controller 76 outputs a control signal to a variable speed motor controller 58 which varies the air flow rate through the return fan 52. The means to achieve this variation may be the same as used for the supply fan 12, including, but not limited to, variable inlet vanes at the fan inlet, discharge dampers located in the fan discharge, a variable-sheave belt and pulley arrangement, or a variable speed motor controller. This variable speed motor controller 58 is a commercially-available unit, an example of which is known as the Air-Modulator, manufactured by York Division, Borg-Warner, the assignee of this invention. The receiver-controller 76 is likewise a commercially-available unit and may be either a proportional-only or proportional-plus-reset type. An example of such devices is the T-9000 series of pneumatic controllers manufactured by Johnson Controls, Inc.

For the particular VAV system with associated controls embodied in FIG. 1, a sequence of operation could be as follows:

The static pressure sensor 30 in the supply duct 20 senses an increase in duct static pressure, most likely a result of a decreased requirement for cooling or heating by the spaces served by the installation as by the closing of control dampers 23. The differential pressure transmitter 32 reacts to this increase in pressure differential by proportionally increasing the air pressure in the control line extending from the transmitter 32 to the receiver-controller 34. The receiver-controller, which in this case is a reverse-acting instrument, compares the input pressure signal from the transmitter 32 to a pre-adjusted setpoint (internal to the receiver-controller), and then causes its output pressure to decrease in some ratio dependent on the magnitude of the difference between the input signal and the setpoint value. The decrease in output pressure to the variable-speed motor controller (which in this particular case is an Air-Modulator, manufactured by York Division, Borg-Warner), causes the AC line frequency to an AC electric motor 74 to decrease, which in turn causes the motor shaft to rotate at a lower speed, which in turn causes the supply fan speed and air flow rate through the supply fan to decrease through the belt-and-pulley arrangement 16. The decrease in air flow rate in the supply duct 20 will itself influence the static pressure sensed by the sensor 30. In this case, the static pressure sensed will decrease, eventually causing the supply air flow rate to stabilize at a reduced flow condition.

As a consequence of the reduction in supply air flow rate, the pressure sensed by the static pressure sensor 72 located within the mixed air plenum 62 will become less negative and the flow rate of the outside air being drawn into the plenum chamber 62 will decrease. However, the decrease in the static pressure within the mixed air plenum 62, relative to an outside reference pressure, will be transmitted by the differential pressure transmitter 74 to the receiver-controller 76 by virtue of a decrease in the control pressure in the pneumatic tubing connecting these two devices. The receiver-controller 76, which in this case is a direct-acting instrument, compares the input pressure signal from the differential pressure transmitter 74 to a pre-adjusted setpoint (internal to the receiver-controller 76), and then causes the output pressure to decrease in some ratio dependent on the magnitude of the difference between the input signal and the setpoint value. The decrease in output pressure to the variable-speed motor controller 58 decreases the rotational speed of the return fan in the same manner as described for the supply fan. The air flow rate through the return fan then will be reduced so as to maintain an essentially constant negative static pressure (with respect to the outside reference) within the mixed air plenum. By properly adjusting the setpoint of the control loop so described (i.e., the desired value of static pressure to be maintained within the plenum chamber), a minimum outside air flow rate will be assured regardless of the supply air flow rate required to suitably cool or warm the spaces.

Figure 2:
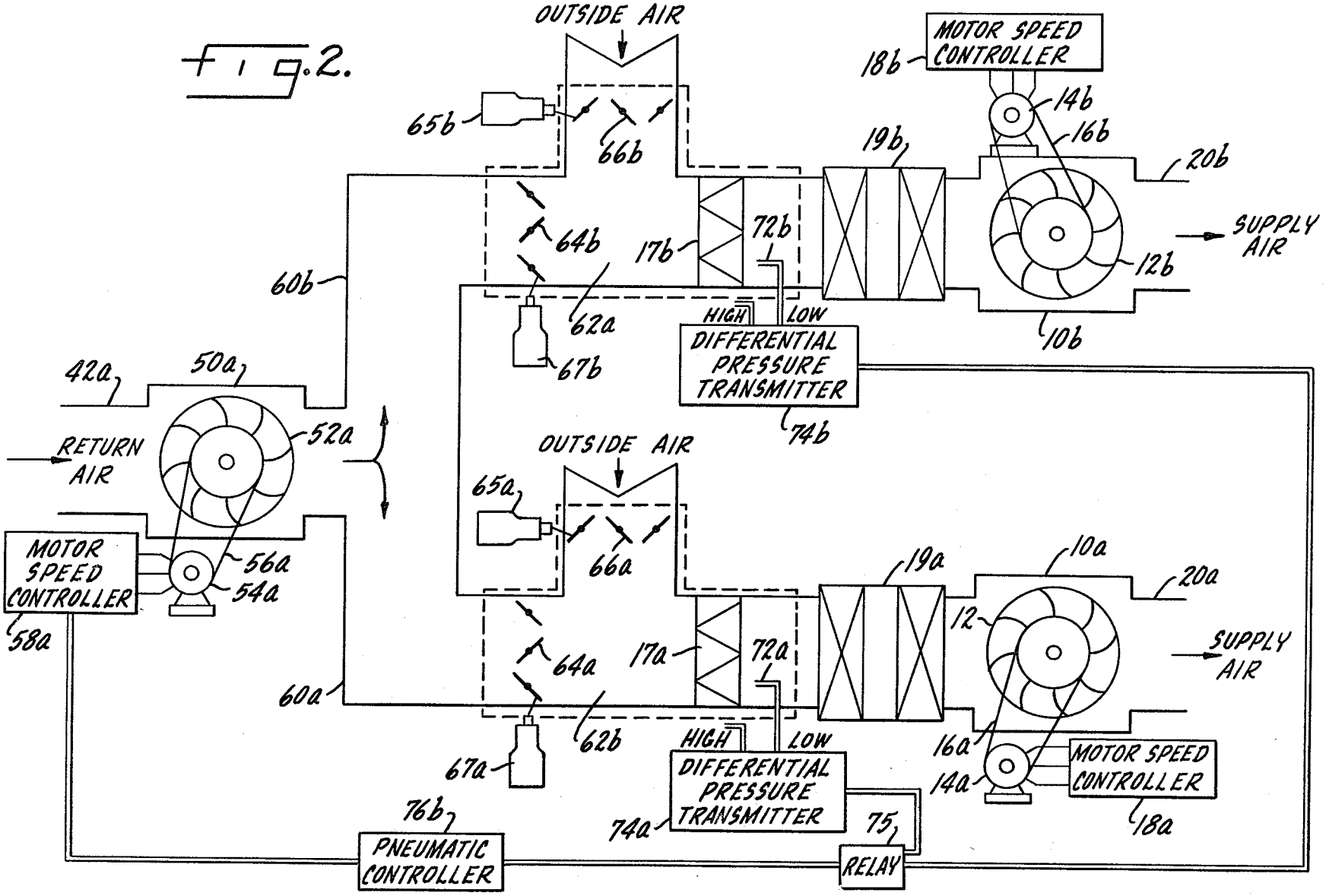
FIG. 2 is a block diagram (or control schematic) of a second embodiment of the invention, which illustrates its application to a VAV system incorporating two or more mixed air plenums and a single return fan.

The particular VAV system with associated controls embodied in FIG. 2 is an application of the principle of mixed air plenum pressure control to a system consisting of two or more mixed air plenum chambers which are connected to a single return fan. The two mixed air plenum chambers **62*a* and 62*b* are connected to supply fan units 10*a* and 10*b* by ductwork. Each supply fan draws air from its plenum chamber and forces it through supply ductwork to the conditioned space(s) served by that supply fan. For the particular system embodied in FIG. 2, the air flow rate through each supply fan 12***a* and 12*b* is controlled based on the static pressure at some point in the supply duct, in a manner which may be similar to that described for the system embodied in FIG. 1. Each of the plenum chambers 62*a* and 62*b* for mixing return and outside air may contain outside air dampers 66*a* and 66*b* and return air dampers 64*a* and 64*b*, located as shown in FIG. 2. A single return fan unit 50*a* consisting of a fan 52*a* driven through a belt and pulley arrangement 56*a* by an electric motor 54*a* draws spent air into the return air ductwork 42*a* from the conditioned spaces and discharges the air into ductwork 60*a* and 60*b* which connects to plenum chambers 62*a* and 62*b*. The air flow rate through the return fan may be varied using a variable speed motor controller 58*a*, a commercially-available unit, an example of which is an Air-Modulator, manufactured by York Division, Borg-Warner, the assignee of this invention. The means used to achieve the variation in air flow rate through the return fan may include, but is not limited to, variable inlet vanes at the fan inlet, discharge dampers located in the fan discharge, variable-sheave belt and pulley arrangements, eddy current clutches, or variable speed, direct current motor drives.

The air flow rate through the return fan unit 50*a* in FIG. 2 is controlled substantially in the same way as described for FIG. 1, with the exception that the static pressure in both mixed air plenum chambers 62*a* and 62*b* is used in the control system. As embodied in FIG. 2, the control system consists of pneumatic differential pressure transmitters 74*a* and 74*b* of identical input pressure ranges, the "LOW" pressure port of each being connected via tubing to static pressure sensors (72*a* and 72*b*) located within respective plenum chambers 62*a* and 62*b*. The "HIGH" pressure port of each transmitter is connected to an outside air pressure reference or some suitable reference static pressure signal representative of the outside barometric pressure. The differential pressure transmitters 74*a* and 74*b* are commercially-available units, an example of which is the P-5217 transmitter manufactured by Johnson Controls, Inc.

The output pressure signals from the differential pressure transmitters 74*a* and 74*b* (typically in the 3–15 psig range) are connected by tubing to a pneumatic relay 75, which may be either of the averaging or low-selecting type, depending on the particular application requirement. If the relay is of the averaging type (an example of which is the RP973A, manufactured by Honeywell, Inc.), then the average of the two transmitter pressures is fed to a pneumatic receiver-controller 76*b*, which will act to maintain an average of the two mixed air plenum pressures. If the relay is of the low-selector type (an example of which is the C-5226, manufactured by Johnson Controls, Inc.), then the lower of the two transmitter pressures is fed to a pneumatic receiver-controller 76*b*. In this case, the controller will act to vary the return air flow rate to maintain the static pressure in the less negative of the two mixed air plenums. The receiver-controller 76*b* is a commercially-available unit and may be either a proportional-only or proportional-plus-reset type, the difference between the two being the control loop relationship between the input and output signals. In this case, the receiver-controller is of the direct-acting type, meaning that the output increases in pressure as the input pressure increases. The receiver-controller 76*b* output (which is typically 3–15 psig) is connected via tubing to the variable speed motor controller 58*a*, which in this case is a variable speed motor controller, and specifically an Air-Modulator. An increasing pressure signal from the receiver-controller causes the return fan speed to increase as described previously, which in turn causes the return air flow rate to increase. The sequence of operation will be the same as described previously, with the exception that the average of the mixed air plenum pressures will be maintained at some setpoint or, if a low-selecting relay is used, the mixed air plenum pressure which is the less negative will be maintained. Control setpoints are adjusted either at the receiver-controller 76*b* or remotely using a pressure regulator connected to an input port of the receiver-controller employing what is known in the trade as a remote setpoint adjuster. Typical setpoints may range from a negative 0.8 inches of water column to a negative 0.2 inches of water column, depending on the outside air quantities required and duct design. In actual practice, the setpoint can be adjusted to insure that minimum outside air flow rates are possible regardless of supply air flow rates.

Numerous adaptations and applications of the control system described will be apparent to those skilled in the art. For example, the invention may be used with multiple return fans which discharge into a single mixed air plenum by using the same signal to control each return fan's flow rate. A system in which at least two supply fans which draw air from a single mixed air plenum can also be controlled using the concept described in this invention. As specifically disclosed, the control system is implemented using conventional pneumatic tubing, transmitters, controllers, and relays. However, the invention may be embodied with electronic digital, analog, or a combination of digital/analog control elements and low-voltage wiring. In this case, the Air-Modulator would vary the motor speed based on an electronic signal rather than a pneumatic signal. The invention encompasses the concept of controlling the air flow rate of a return fan or fans based on the maintenance of an essentially constant negative static pressure within a mixed air plenum connected by ductwork to the controlled return fan. The invention should be interpreted to embrace all modifications and adaptations of this concept.

We claim:

1. A variable air volume conditioning system for maintaining the inflow of outside air above a predetermined rate regardless of the volume of the air being supplied to a conditioned space, said system comprising:

a. a duct system including a supply duct for delivering supply air to a conditioned space and a return duct for returning a portion of the air supplied to said conditioned space;

b. a plenum chamber in said duct system, said chamber having an outside air inlet, a return air inlet, and an outlet communicating with said supply duct;

c. air conditioning means for attempering the stream of mixed outside air and return air downstream from said plenum chamber;

d. a supply air fan associated with said supply duct;

e. a return air fan associated with said return duct; and f. means, interconnected between said plenum chamber and said return air fan, for sensing the static pressure in said plenum chamber and for controlling the speed of the return air fan so as to maintain the plenum chamber pressure at a substantially constant negative level relative to a fixed reference level.

2. A system as recited in claim 1 in which said means for sensing static pressure and for controlling the speed of the return air fan includes:

a. a static pressure sensor in the plenum chamber for measuring static pressure and for providing an output signal indicative of the change in plenum static pressure; and b. a proportional transducer means for receiving an output signal from said sensor and for converting to a control signal for controlling the return air fan speed.

3. A system as recited in claim 2 in which a receiver-controller means is positioned between said sensor and said transducer for inverting the output signal of said sensor and for transmitting said output signal to the transducer means.

4. A system as recited in claim 2 in which:

a. said system includes at least two supply ducts and fans connected to said plenum chamber;

b. a static pressure sensor is positioned between each supply fan and the outside air inlet; and c. each of said sensors provide an output signal to a relay which averages the signals of the two sensors and provides an averaged static pressure signal to the receiver-controller means.

5. A control unit for a variable air volume conditioning system having a supply air fan for delivering conditioned air through a duct system to a conditioned space, a return air fan for pulling air from said conditioned space to the supply air fan through said duct system outside air inlet, said control unit comprising:

a. a static pressure sensor for measuring the static pressure of the duct system at a point between said outside air inlet and said supply air fan and for providing an output signal indicative of a change in the magnitude of the static pressure of the duct system;

b. a receiver-controller means connected to said static pressure sensor for receiving its output signal, and for providing an output signal whose magnitude is inversely proportional to the output signal of the sensor;

c. proportional transducer means for receiving the output signal of the receiver-controller and for converting said output signal to an input control signal of a return air fan speed control means; and d. return air fan speed control means receiving said input control signal for controlling the speed of the return air fan to maintain a preselected static pressure in a portion of the duct system between the outside air inlet and the supply air fan.

6. A control unit as recited in claim 5 in which:

a. said pressure sensor and said receiver-controller means are pneumatic devices;

b. said transducer means is a pneumatic-electric device which converts a pneumatic signal into a direct current voltage signal of a mangitude proportional to the magnitude of the pneumatic; and c. said return air fan speed control means varies power delivered to the return air fan in proportion to the magnitude of the voltage signal of the transducer.

* * * * *